US010399378B1

(12) United States Patent
Mitchell

(10) Patent No.: US 10,399,378 B1
(45) Date of Patent: Sep. 3, 2019

(54) BRUSH BREATHER

(71) Applicant: Laurence Mitchell, Toledo, OH (US)

(72) Inventor: Laurence Mitchell, Toledo, OH (US)

( * ) Notice: Subject to any disclaimer, the term of this patent is extended or adjusted under 35 U.S.C. 154(b) by 0 days.

(21) Appl. No.: 15/330,646

(22) Filed: Dec. 27, 2016

(51) Int. Cl.
*B44D 3/12* (2006.01)
*B44D 3/14* (2006.01)

(52) U.S. Cl.
CPC ..... *B44D 3/123* (2013.01)

(58) Field of Classification Search
CPC ..... B44D 3/12; B44D 3/121; B44D 3/123; B44D 3/127
USPC ..... 220/736
See application file for complete search history.

(56) References Cited

U.S. PATENT DOCUMENTS 1,451,984 A * 4/1923 Jordan ..... B27G 11/02 206/229
1,496,346 A * 6/1924 Lindmark ..... B44D 3/123 15/168
2,259,927 A * 10/1941 Dunton ..... A47J 47/18 220/736
2,566,877 A * 9/1951 Dunton ..... B44D 3/123 16/355
3,581,904 A * 6/1971 Selby ..... B44D 3/123 210/470
3,688,943 A * 9/1972 Brown ..... B44D 3/123 15/257.05
4,491,234 A * 1/1985 Wilcock ..... B44D 3/121 15/257.01
4,721,225 A * 1/1988 Sobel ..... B44D 3/123 15/257.05
4,865,282 A * 9/1989 Yonkman ..... B44D 3/123 15/257.06
4,867,332 A * 9/1989 Mains ..... B25H 3/04 206/372
5,038,955 A * 8/1991 Studer ..... B44D 3/123 15/257.06
D327,148 S * 6/1992 Alessi ..... D32/54
5,207,348 A * 5/1993 Fischer ..... B44D 3/123 220/697
5,297,695 A * 3/1994 Provence ..... B44D 3/123 220/23.83
D346,054 S * 4/1994 Spangler ..... D32/54
5,546,628 A * 8/1996 Silvera ..... B44D 3/123 15/257.05
5,549,216 A * 8/1996 Scholl ..... B44D 3/12 220/695
5,687,873 A * 11/1997 Jones ..... A46B 220/736
5,781,959 A * 7/1998 Tipotsch ..... A47L 13/58 15/263
6,446,829 B1 * 9/2002 Malvasio ..... B44D 3/123 220/697
7,172,090 B2 * 2/2007 Jackson ..... B44D 3/12 220/695
D633,717 S * 3/2011 Searcy ..... D3/310
9,119,490 B1 * 9/2015 Parodi, Jr. ..... A47G 19/2205
9,669,654 B1 * 6/2017 Wager ..... B44D 3/128

* cited by examiner

*Primary Examiner* — Joshua E Rodden

(57) ABSTRACT

An attachable and detachable holder for wet paint brushes which can be mounted on a top lip of a conventional paint can or paint bucket. An outwardly extending hook holds the holder to an inside of the paint can or paint bucket. The holder holds enough paint that covers paint brush hairs when the paint brush is placed in a holder area of the holder. Side port holes in the holder allow excess paint in the holder to flow back into the paint can or bucket.

1 Claim, 1 Drawing Sheet

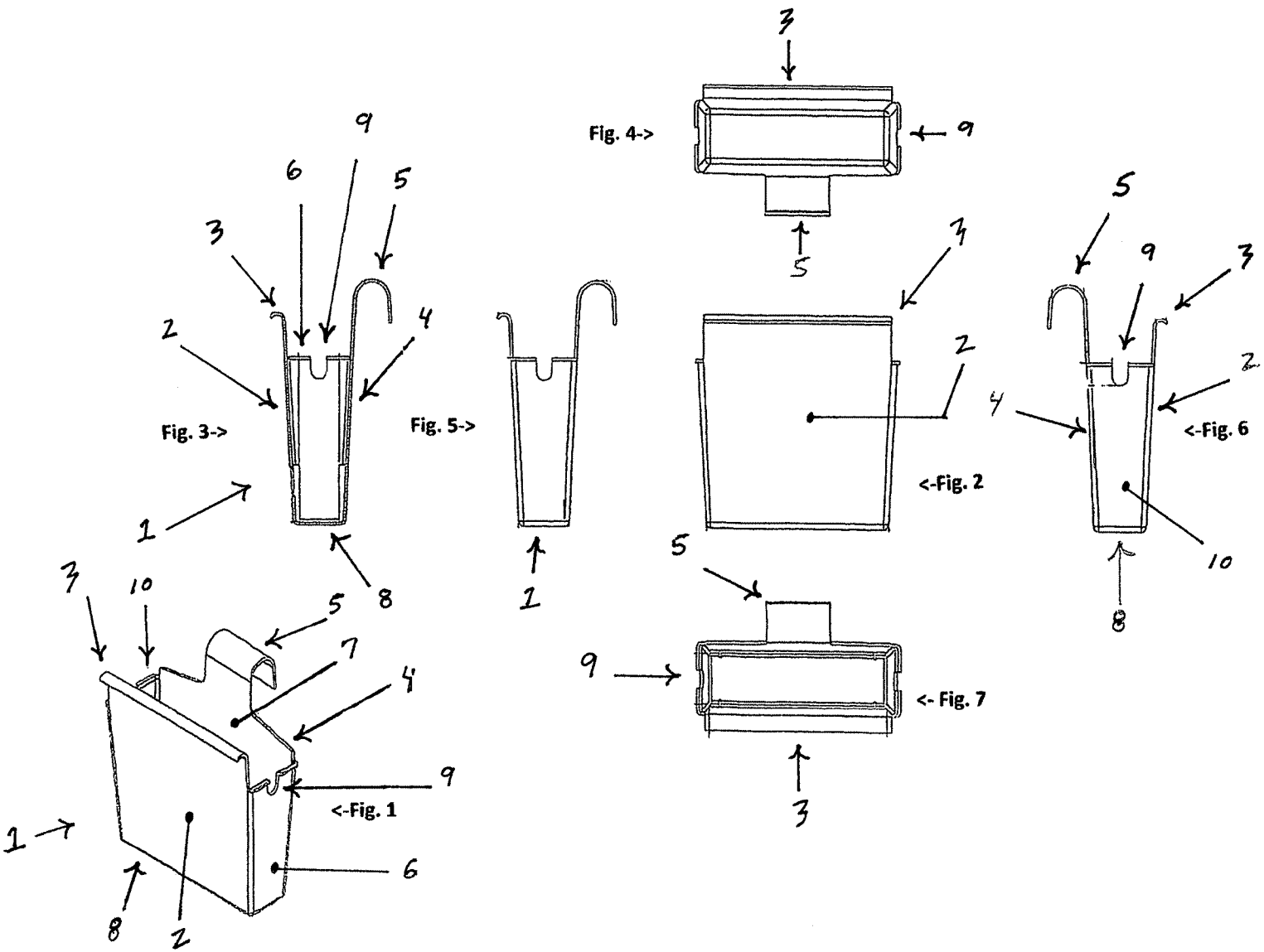
Fig. 4->
<-Fig. 2
<- Fig. 7
Fig. 5->
<-Fig. 6
Fig. 3->
<-Fig. 1

BRUSH BREATHER

FIELD

This invention pertains to a holder for wet paint brushes and more precise, it pertains to a holder for wet paint brushes that is readily, easily and securely mounted onto a conventional paint can or bucket and is located on an inside of the paint can or bucket keeping the paint brushes wet while returning excess paint from the holder back into the paint can or bucket.

BACKGROUND OF THE INVENTION

Inventor is aware of an assortment of attachments to paint cans or buckets for holding a paint brush. Those attachments are shown in both U.S. design and utility patents. Those attachments are for the exterior of a paint can.

This invention improves upon the prior attachments in significant ways. The improvements are the fact that this invention unlike the others, sits inside the paint can or paint bucket safely containing the wet paint brush and returning excess paint safely to the inside of the paint can or paint bucket. The shape and size of the invention does not interfere or obstruct the up and down movement of the paint brush. Having the holder safely located on the inside of paint cans and paint buckets minimizes external hazards which happens with holders attached outside the paint can or paint bucket. The holder being located inside the paint can or paint bucket allows users to take the holder while in the paint can or bucket safely up a ladder.

Additionally, the invention does not interfere with the paint can or paint bucket handle. The invention holds the paint brush safely while the paint can or paint bucket is being moved or waiting to be moved.

Additionally the invention holds the proper amount of paint to keep the paint brush hair wet and covered with paint preventing the paint brush from drying out.

BRIEF DESCRIPTION OF THE DRAWINGS

FIG. 1 is a top perspective view of the holder.

FIG. 2 is the front view that faces the inside of a paint can or paint bucket.

FIG. 3 is the right side view showing the paint return port hole, the outwardly extending hook and wiper edge.

FIG. 4 is the top view looking down on the holder.

FIG. 5 is the right side view showing the paint return port hole, the outwardly extending hook and wiper edge.

FIG. 6 is the left side view showing the paint return port hole, the outwardly extending hook and wiper edge.

FIG. 7 is the top view looking down on the holder.

DETAILED DESCRIPTION

The drawings and this description disclose a holder 1 for wet paint brushes and an attachment arm 5. Those two sections are together in one integral unit and are easily attachable and easily removable to a conventional paint container. The holder 1 can be made of plastic which is sufficiently sturdy for the purpose. The holder 1 is for connecting to an upper lip of most paint containers. The entire assembly with the paint container is such that there is not obstruction in the repeat action of dipping the brush into a main body of paint which is in the paint container.

FIG. 1 shows a holder 1 capable of being mounted onto a conventional upper lip of a conventional paint can or paint bucket (not shown). The holder 1 has the attachment arm 5 in the form of an outwardly extending, downwardly facing hook 5 that can attach to most upper lips of paint containers. Once the holder 1 is in position, the painter can dip the paint brush into the paint container without any obstruction.

FIGS. 1 and 3 are used to show a wiping edge 3 for the brush, the wiping edge 3 being in the form of a downwardly facing hook for the brush. The wiping edge 3 allows for the removal of excess paint from the paint brush to fall back into the holder 1 where it will be eventually mixed with the main body of paint.

FIG. 1 shows the holder 1 having the wiping edge 3 and the outwardly extending hook 5 being integral relative to each other and made in a single plastic molding process. The holder has four upright walls in the form of a front wall 2, a back wall 4, two side walls 10 and 6, and a bottom wall 8 to create a liquid tight container having a rectangular cross section. Thereby the container presents an upwardly open brush compartment 7 with its upper portion being open to receive a paint brush or multiple paint brushes. The holder 1 shows the wiping edge 3 being a same length as the holder 1. The wiping edge 3 extends along the front wall 2 of the holder 1. The outwardly extending hook 5 extending along the back wall 4 and having a length which is less than the length of the holder 1.

FIGS. 1, 3, 5 and 6 shows the walls 2, 4, 10 and 6 tapered relative to each other so a plurality of the units can be nested and stacked for space conservation.

The holder 1 as in FIG. 1 is made so that the hook 5 can be moved onto and off the lip of paint cans and paint buckets. The outwardly extending hook 5 is simply placed over the lip. The length and width of the outwardly extending hook 5 when set in place assures the securement of the holder 1 to most paint cans and paint buckets. The outwardly extending hook 5 once placed on the lip keeps the holder 1 in the correct upright position to hold paint and to hold a paint brush or multiple paint brushes.

The holder 1 is simply lifted straight up by either grabbing the outwardly extending hook 5 or grabbing another portion of the holder 1 and lifting it straight up away from the paint can or paint bucket.

The holder 1 includes port holes 9 in the side walls 10 and 6 of the holder 1 such that when the holder 1 contains excess paint, said excess paint flows through the port holes 9 and then drops down to the main body of paint in the paint can or paint bucket upon which the holder 1 is attached. The port holes 9 extend downwardly from a top edge of the side walls 10 and 6 of the holder 1 and have a U-shaped bottom portion.

In all instances, the holder 1 serves to keep a paint brush wet with paint and return excess paint to the main body of paint in the paint can or bucket. In all instances said holder 1 can be easily attached to and removed from the paint can or paint bucket.

The invention claimed is:

1. A holder for wet paint brushes which is configured to be securely mounted onto the inside of a paint can or bucket, the holder comprising:

A body of the holder having a front wall, a back wall, two side walls interconnecting respective sides of the front and back walls, and a bottom wall, each of the walls creating a liquid tight area of the body having a rectangular cross section with an upwardly opening brush compartment, the front wall, the back wall and the side walls forming a rectangular cross section along a vertical height of the body of the holder, and the front wall, the back wall and the side walls being tapered relative to one another;

A wiping edge for the removal of excess paint from the wet paint brushes, the wiping edge in the form of a downwardly facing hook attached along a top edge of the front wall, the wiping edge extending along an entire length of the top edge of the front wall;

An outwardly extending hook for attaching the holder to the inside of the paint can or bucket, the outwardly extending hook in the form of a downwardly facing hook attached along a top edge of the back wall, the outwardly extending hook extending along less than an entire length of the top edge of the back wall;

A plurality of port holes, one of the plurality of port holes being located on each respective side wall of the holder, the port hole extending downwardly from a top edge of the respective side wall and having a U-shaped bottom portion;

The top edge of each of the side walls being located beneath the top edge of the front wall and the top edge of the back wall.

* * * * *